US005092015A

United States Patent [19]

Kosten et al.

[11] Patent Number: 5,092,015

[45] Date of Patent: Mar. 3, 1992

[54] HAND-HELD VACUUM CLEANER WITH ATTACHMENT CONNECTOR

[75] Inventors: Richard B. Kosten, West Haven; Charles Z. Krasznai, Trumbull; Robert Osit, Shelton, all of Conn.

[73] Assignee: Black & Decker Inc., Newark, Del.

[21] Appl. No.: 637,414

[22] Filed: Jan. 4, 1991

[51] Int. Cl.[5] ..... A47L 9/24

[52] U.S. Cl. ..... 15/338

[58] Field of Search ..... 15/338

[56] References Cited

U.S. PATENT DOCUMENTS

| | | | |
|---|---|---|---|
| 1,773,961 | 8/1930 | Dance | 15/338 X |
| 2,871,504 | 2/1959 | Gall et al. | 15/338 |
| 4,008,505 | 2/1977 | Clowers | 15/338 |
| 4,700,428 | 10/1987 | Hetherington | 15/338 |
| 4,891,861 | 1/1990 | Sovis et al. | 15/344 |

FOREIGN PATENT DOCUMENTS

| | | | |
|---|---|---|---|
| 519664 | 4/1940 | United Kingdom | 15/338 |

*Primary Examiner*—Chris K. Moore
*Attorney, Agent, or Firm*—Barry E. Deutsch

[57] ABSTRACT

A hand-held vacuum cleaner including a housing comprising mating first and second half housing elements. The housing has a handle and a nozzle. A motor is mounted within the housing for driving a shaft. A fan is mounted on the shaft for rotation therewith. A selectively separable bag assembly is mounted on the housing. A working channel is defined within the housing communicating the nozzle with the bag assembly. A connector joins a hose or similar attachment to the vacuum cleaner. The connector extends the flow path of the working air from the attachment to the nozzle. The connector comprises a first section for direct engagement with the attachment and a second section adapted for fitting over the housing in underlying registration with the nozzle. The second section includes a fluid flow channel and an edge wall surrounding the fluid flow channel and an edge wall surrounding the fluid flow channel and having an extent and configuration to fit in substantially fluid tight engagement with the nozzle. A pair of spaced apart hook-shaped projections extend outwardly from the edge wall. A releasable latch is movably connected to the edge wall on the side opposite the projections.

1 Claim, 3 Drawing Sheets

FIG.3
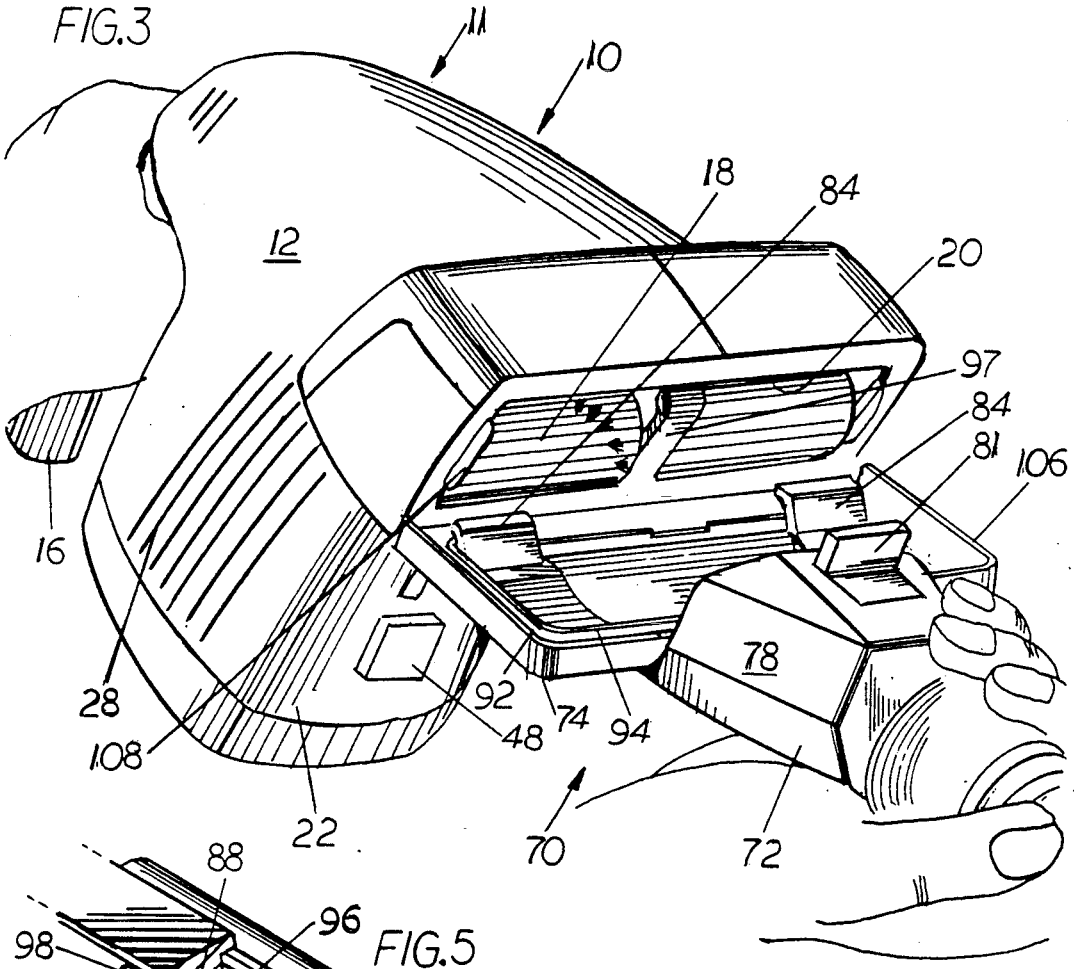
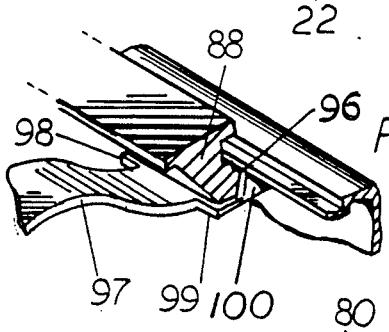
FIG.5
FIG.4
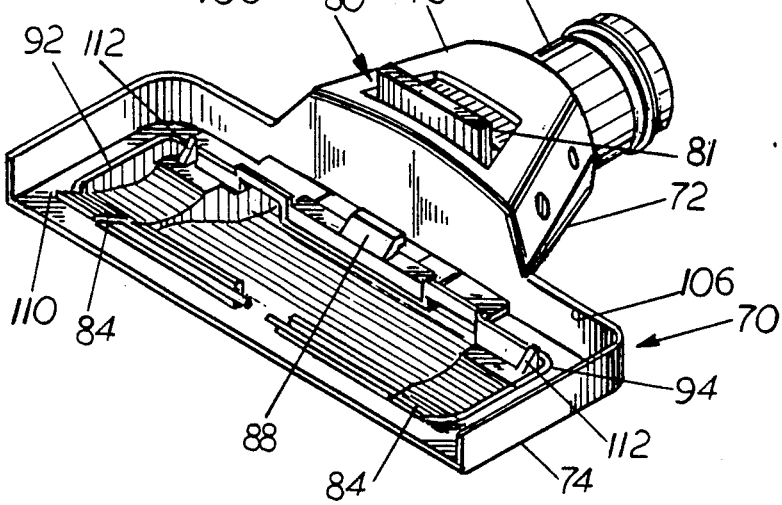

HAND-HELD VACUUM CLEANER WITH ATTACHMENT CONNECTOR

BACKGROUND OF THE INVENTION

This invention relates to hand-held vacuum cleaners and in particular to hand-held vacuum cleaners having an attachment connector.

AC powered hand-held vacuum cleaners have become increasingly popular in the past several years. Such cleaners are particularly useful where conventional larger size vacuum cleaners such as large canister or upright types are inconvenient for the user. Such hand-held vacuum cleaners are particularly useful in cleaning stairs and furniture. Examples of these AC powered hand-held vacuum cleaners are found in U.S. Pat. Nos. 4,700,428 and 4,891,861.

Very often it is desirable to extend the working air flow path of the cleaner by attaching a hose or other attachment to the cleaner. Heretofore, many of the commercially available hand-held vacuum cleaners have required that the user disengage or remove the drive belt employed to operate the rotary brush of the cleaner making the rotary brush inoperable. Removal of the drive belt has generally been relatively time consuming and inconvenient to the user.

A connector for attaching the hose to a hand-held vacuum cleaner is illustrated in U.S. Pat. No. 4,700,428. The connector illustrated in this patent is relatively costly to manufacture and is not as simple to use as might be desired.

Accordingly, it is an object of this invention to provide a connector for a hand-held vacuum cleaner which permits an accessory to be readily connected to the cleaner without requiring any removal of the drive belt.

SUMMARY OF THE INVENTION

The foregoing object and other objects of the invention are attained in a hand-held vacuum cleaner including a housing comprising mating first and second half housing elements. The housing includes a handle and a nozzle. A motor is mounted within the housing for driving a shaft. A fan is mounted on the shaft for rotation therewith. A selectively separable bag assembly is mounted on the housing. Means define a working air channel within the housing communicates the nozzle with a bag assembly. A connector for joining a hose or similar attachment to the vacuum cleaner extends the flow path of the working air from the attachment to the nozzle. The connector comprises a first section for direct engagement with the attachment and a second section adapted for fitting over the housing in underlying registration with the nozzle. The second section includes a fluid flow channel, an edge wall surrounding the fluid flow channel and having an extent and configuration to fit in substantially fluid tight engagement with the nozzle, a pair of spaced apart hook-shaped projections extending outwardly from the edge wall and releasable latch means movably connected to the edge wall on the side thereof opposite the hook-shaped projections. The nozzle includes first wall means for pivoting engagement with the hook-shaped projections and second wall means for releasable engagement with said latch means.

BRIEF DESCRIPTION OF THE DRAWING

FIG. 3 is a perspective view illustrating the manner in which the connector is attached to the cleaner by the user;

FIG. 4 is a perspective view of the connector; and

FIG. 5 is a fragmentary perspective view of a detail of the connector and cleaner illustrated in FIG. 2.

DESCRIPTION OF THE PREFERRED EMBODIMENT

Figure 1:
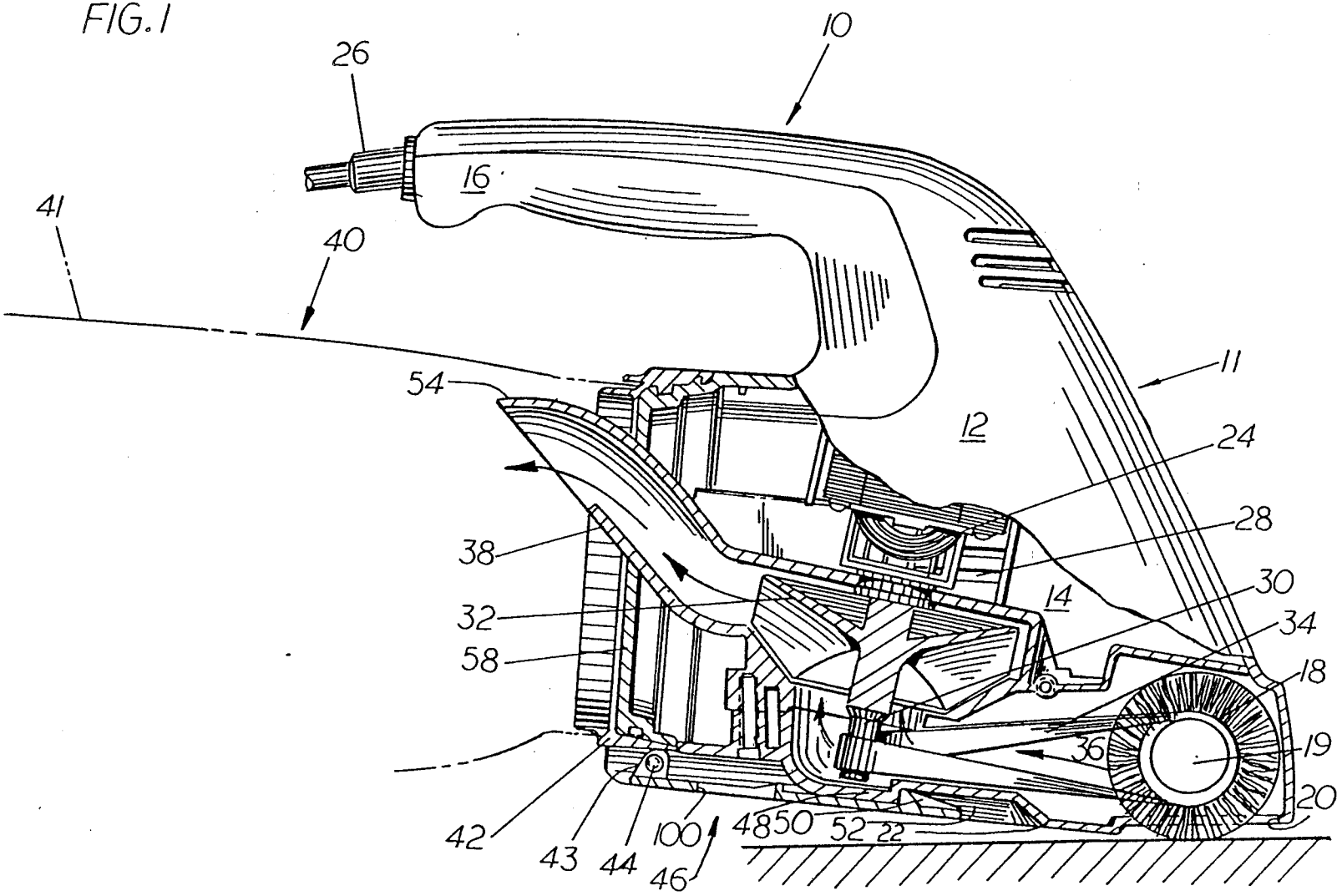
FIG. 1 of the drawing is a side view, partially in cross section, of a hand-held vacuum cleaner embodying the present invention.

Referring now to the drawing, there is disclosed a hand-held vacuum cleaner generally designated by the reference numeral 10. In referring to the various figures of the drawing, like numerals shall refer to like parts. Vacuum cleaner 10 comprises a housing generally designated by reference numeral 11. The housing has two mating half elements 12, 14 which are joined together via a tongue and groove joint. A handle 16 extends outwardly from the top of housing 11. Housing 11 includes a member 22 defining the lower wall of cleaner 10. Member 22 is removably connected to first and second half housing elements 12, 14. Member 22 has an opening 20 defining the intake nozzle for vacuum cleaner 10. A rotating brush 18 is mounted within the nozzle. Brush 18 includes a spindle 19 which is mounted in opposed bearing housing cavities (not shown) mounted in the side wall of member 22. An endless belt 34 is wrapped around spindle 19 for rotationally driving brush 18.

A motor 24 is supported between the two half housing elements 12, 14. The motor is mounted in a vertical orientation with respect to the floor on which the vacuum cleaner 10 is supported. Motor 24 is operated by a source of AC power. Motor 24 is connected to the source of power via AC power plug 26. Each of the half housing elements includes a plurality of air vents 28 for providing cooling air to and from the motor.

Motor 24 drives a shaft 30 connected thereto. Fan 32 is mounted on shaft 30 for rotation therewith. Shaft 30 also is connected to belt 34 which, as described previously, drives brush 18. Internal walls of half housing elements 12, 14 define, in part, working air channel 36. Channel 36 commences at nozzle 20 and terminates at an outlet chute 38. Outlet chute 38 directs the working air drawn into the vacuum cleaner into a dirty air bag assembly 40. The upper surface of outlet chute 38 includes a generally arcuate or curved wall 54 for directing the working air towards the rear of the bag. Curved wall 54 deflects any debris entrained within the working air away from the user and enables the velocity of the entrained debris to decrease before the debris hits any surface of the bag. Curved wall 54 facilitates the filling of the bag. It is particularly important to note that outlet chute 38 is positioned at the top of the bag assembly. It has been determined that more dirt can be captured within a given size bag when the chute is positioned at the top of the bag assembly rather than at the bottom thereof.

Bag assembly 40 includes a dirt collector bag 41 which is attached to a collar 42. Bag assembly 40 is removably secured to housing 11. Collar 42 includes a pair of depending spaced bosses 43 which provide support for a pivot pin 44. A combined handle and latch member 46 is pivotally attached to pivot pin 44. Collar 42 has an inwardly extending finger 62 formed on its top surface. Finger 62 mates with an indented section 64 formed in the top of housing 11 so that the collar and attached bag assembly 40 are properly aligned on the housing.

Handle and latch member 46 includes a slightly canted upwardly extending rib 50 provided at its forward end. Rib 50 mates with a detent 48 formed on member 22 to latch the collar and bag assembly onto housing 11. Lower wall 22 further includes a pair of guide ribs 52 for guiding rib 50 on handle and latch member 46 into proper position with respect to detent 48. For a more detailed description of the air flow path within cleaner 10 reference may be made to copending application, Ser. No. 637,412,.filed concurrently herewith in the name of Charles A. Reed, Jr. and assigned to the same assignee as the assignee hereof. A more detailed explanation of the latch and sealing arrangement for bag assembly 40 is described in copending application, Ser. No. 637,413, filed concurrently herewith in the names of Charles A. Reed, Jr., Charles Z. Krasznai, Richard B. Kosten and Robert Osit and assigned to the same assignee as the assignee hereof.

At times, the user of vacuum cleaner 10 may desire to employ an attachment such as a hose and crevice tool. The hose extends the working air flow path. In some of the prior art hand-held vacuum cleaners, it has been necessary to detach belt 34 and render brush 18 inoperable when an attachment is connected to the cleaner. Detachment of the belt is generally not a user friendly operation. In other cleaners of the type described, a connector has been inserted between the attachment and nozzle of the cleaner. The connector of the prior art has been relatively more expensive to manufacture and has not been as user friendly as the connector to be more fully described hereinafter.

Referring now to FIGS. 2–5, the attachment connector of the present invention will be described in detail. The attachment connector is generally designated by the reference numeral 70.

Connector 70 includes a first section 72 and a second section 74. First section 72 includes a generally cylindrical portion 76 which mates directly with the attachment such as a hose. Portion 76 extends from a generally rhomboid shaped housing portion 78. An operating lever 81 of a latch assembly 80 extends through the top surface of housing 78. Latch assembly 80 further includes a latch member 88 to be more fully described hereinafter. A leaf spring 90 biases latch assembly 80 towards cylindrical portion 76.

Connector 70 includes a fluid flow path. A first portion 102 of the flow path is defined b first section 72 and a second portion 104 of the flow path is defined by second section 74. Second portion 104 of the flow path is in fluid flow communication with nozzle 20.

Second section 74 includes an outer wall 106 extending along the front and both sides of connector 70; the rear of second section 74 is open. A four sided inner edge wall 92 is spaced from outer wall 106 and is dimensioned to fit in substantially fluid tight engagement with nozzle 20 when placed in underlying registration therewith. A gasket 94 is held between the outer surface of edge wall 92 and the inner surface of the wall defining nozzle 20 to insure a fluid tight seal between the respective walls. The space between opposed surfaces of walls 92 and 106 is designated by reference numeral 110.

The front wall defining nozzle 20 includes a pair of spaced vertically extending ribs 98, 100 which define a pocket 96. As illustrated in FIGS. 3 and 5, nozzle 20 is bisected by a rib 97 which includes base 99 defining a bottom wall of pocket 96 Pocket 96 is sized so that it receives latch member 88 of latch assembly 80 in a snap-fit engagement when connector 70 is placed on cleaner 10. Each of the side walls defining nozzle 20 includes a depending rib 108. Depending ribs 108 fit in space 110 when connector 70 is attached to housing 11.

A pair of angled ribs 112 are spaced laterally to and equidistantly from latch member 88.

Figure 2:
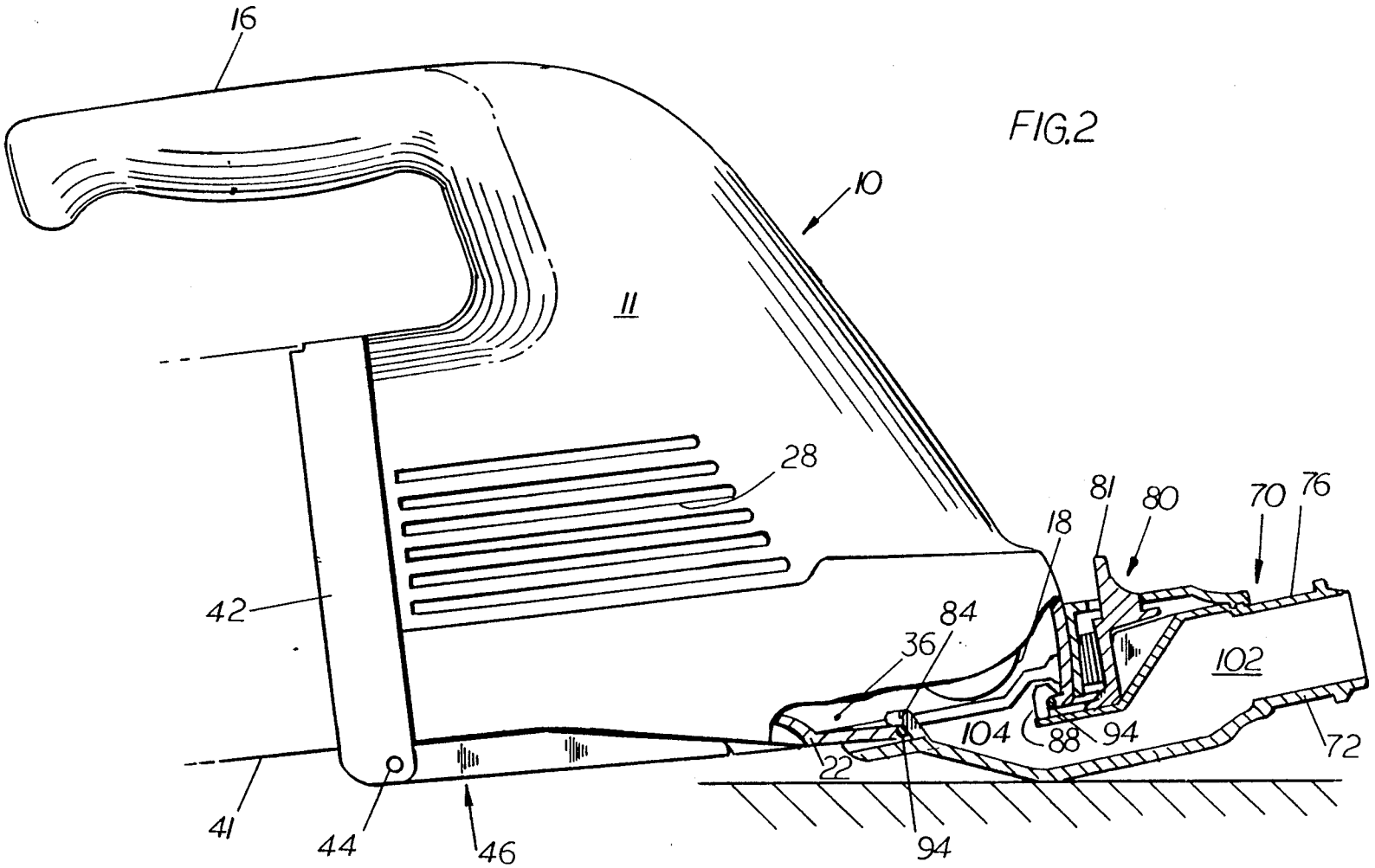
FIG. 2 is a side elevational view, partially in cross section, illustrating the connector of the present invention as attached to the vacuum cleaner of FIG. 1.

As illustrated in FIG. 2, when the user of the cleaner desires to place connector 70 onto the cleaner, the user grabs handle 16 of the cleaner with one hand and uses the other hand to place the connector onto housing 11 of cleaner 10. In particular, hook-shaped projections 84 extending from the rear of second section 74 are placed into engagement with the rear wall of the housing defining nozzle 20. Hook-shaped projections 84 enable the user to pivot connector relative to the housing s that the connector rotates in a counter clockwise direction as viewed in FIG. 2 resulting in latch member 88 of latch assembly 80 being forced into pocket 96. The combination of inner edge wall 92, gasket 94 and the inner surface of the housing defining nozzle 20 defines a seal between connector 70 and cleaner 10. Depending ribs 108, angled ribs 112 and hook-shaped projections 84 cooperate to prevent any lateral or axial movement of connector 70 relative to housing 11 when cleaner 10 is in use.

When it is desired to remove connector 70 from cleaner 10, operating lever 81 is moved towards the cleaner housing in opposition to the force provided by leaf spring 90. This moves latch member 88 from pocket 96 thereby enabling the user to pivot connector 70 about projections 84 and out of engagement with nozzle 20.

While a preferred embodiment of the present invention has been described and illustrated, the invention should not be limited thereto, but may be otherwise embodied within the scope of the following claims.

What is claimed is:

1. A hand-held vacuum cleaner including a housing comprising mating first and second half housing elements, said housing having a handle and a nozzle, a motor mounted within the housing for driving a shaft, a fan mounted on said shaft for rotation therewith, a selectively separable bag assembly mounted on said housing, means defining a working air channel within said housing communicating said nozzle with said bag assembly, and a connector for joining a hose or similar attachment to the vacuum cleaner, said connector extending the flow path of the working air from said attachment to said nozzle, said connector comprising a first section for direct engagement with the attachment and a second section adapted for fitting over the housing in underlying registration with the nozzle, said second section including a fluid flow channel, an edge wall surrounding said fluid flow channel and having an extent and configuration to fit in substantially fluid tight engagement with the nozzle, a pair of spaced apart hook-shaped projections extending outwardly from said edge wall and releasable latch means movably connected to said edge wall on the side thereof opposite said hook-shaped projections and said nozzle including first wall means for pivoting engagement with said hook-shaped projections and second wall means for releasable engagement with said latch means, said latch means including a latch member and said second wall means including a pair of spaced ribs defining a pocket for receiving said latch member in a snap-fit engagement.

* * * * *